US011556084B2

(12) United States Patent
Nomura

(10) Patent No.: US 11,556,084 B2
(45) Date of Patent: Jan. 17, 2023

(54) IMAGE INSPECTION APPARATUS, IMAGE FORMING APPARATUS, AND CONTROL METHOD

(71) Applicant: KONICA MINOLTA, INC., Tokyo (JP)

(72) Inventor: Shoichi Nomura, Machida (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/456,665

(22) Filed: Nov. 29, 2021

(65) Prior Publication Data

US 2022/0179349 A1 Jun. 9, 2022

(30) Foreign Application Priority Data

Dec. 3, 2020 (JP) ..... JP2020-200663

(51) Int. Cl.
*G03G 15/00* (2006.01)

(52) U.S. Cl.
CPC ..... *G03G 15/5041* (2013.01); *G03G 15/5025* (2013.01)

(58) Field of Classification Search
CPC ..... G03G 15/5041; G03G 15/5025; G03G 15/5062
See application file for complete search history.

(56) References Cited

U.S. PATENT DOCUMENTS

2013/0155428 A1* 6/2013 Mizuno ..... G03G 15/5062 358/1.9
2021/0080888 A1* 3/2021 Ishii ..... G03G 15/5041

FOREIGN PATENT DOCUMENTS

JP 2020057902 A 4/2020

* cited by examiner

*Primary Examiner* — Sandra Brase
(74) *Attorney, Agent, or Firm* — Buchanan Ingersoll & Rooney PC

(57) ABSTRACT

An image inspection apparatus includes the following. A reader reads a sheet in which an image is printed, reads the sheet together with a background, and obtains a read image. A background member is provided in a position which is to be a background of the sheet when the sheet is read by the reader. A hardware processor extracts sheet outline information of the sheet from the read image and measures a misalignment of a position of the image with relation to the sheet based on the extracted sheet outline information. The hardware processor performs control based on a measured result of the misalignment of the position of the image. The hardware processor adjusts a degree of control performed based on the measured result of the misalignment of the position of the image according to a density difference between the sheet and the background member.

16 Claims, 10 Drawing Sheets

IMAGE INSPECTION APPARATUS, IMAGE FORMING APPARATUS, AND CONTROL METHOD

CROSS-REFERENCE TO RELATED APPLICATIONS

The entire disclosure of Japanese Patent Application No. 2020-200663 filed on Dec. 3, 2020 is incorporated herein by reference in its entirety.

BACKGROUND

Technological Field

The present invention relates to an image inspection apparatus, an image forming apparatus, and a control method.

Description of the Related Art

As a means of adding value to printed materials, there are known image forming apparatuses that use a fifth color toner in addition to the usual YMCK color material (toner in electrophotographic methods, hereinafter referred to as toner). Among such apparatuses, printing using white toner in particular is increasing, and black sheets are effective to bring out the effect of the white toner.

In order to adjust the misalignment of the image position with relation to the sheet in the image forming apparatus, for example, there is a known technique in which small registration marks (image for position adjustment) are printed at the four corners of the sheet to the extent that they do not have an influence on the image contents, and the positions of the sheet outline (sheet edge) and the registration marks are read by a reading apparatus in order to measure the distance between the above. With this, the adjustment of the position of the image with relation to the sheet when the image is printed is performed (image position adjustment). Typically, a background member of a reading apparatus is black in order to easily read a white sheet, and therefore, it is difficult to read the outline of the sheet of the black sheet. In view of the above, there are background members in which the density can be suitably switched to be appropriate for the sheet used in printing. For example, JP 2020-57902 describes providing a background member that can be switched among a plurality of background colors and the color of the background member can be suitably switched according to the color of the sheet.

SUMMARY

For example, there is an adjustment method for adjusting the position of the image by printing the registration marks in four corners (position separated from the image contents when cut in a later process) of each sheet in the job (print job), reading the position of the sheet outline and the registration mark with the reading apparatus and measuring the distance, and suppressing the change of the image position during the job based on the measured result (called real time image position adjustment). In this case, for example, the printing may be performed with the sheets conveyed from different sheet trays for each page in one job, and there may be a job in which one sheet tray is white and the other sheet tray is black, for example. In this case, if the color of the sheet switches frequently in each page, according to the technique described in JP 2020-57902, there is a problem that the control of switching the background member becomes difficult. During the job, the background member is fixed to white or black and the reading is performed. When the density of the sheet and the background member is close, the possibility that an error such as an error in reading the sheet outline occurs increases. As a result, for example, if control is performed to measure the misalignment of the position of the image during the job and the printed product with large misalignment in the position of the image is eliminated as a defect (waste paper) or the adjustment value of the image position is updated during the job to solve the misalignment of the position of the image, the misalignment of the position of the image is excessively detected in the page in which the density between the sheet and the background member is similar. As a result, the waste paper is generated excessively or the adjustment value during the job varies. Consequently, the position of the image becomes unstable.

The present invention is conceived in view of the above problems, and the purpose of the present invention is to reduce problems that occur when the outline of the sheet cannot be obtained accurately from the read image due to the difference in the densities between the sheet and the background member being small.

To achieve at least one of the abovementioned objects, according to an aspect of the present invention, an image inspection apparatus reflecting one aspect of the present invention is shown, the apparatus including a reader which reads a sheet in which an image is printed, which reads the sheet together with a background, and which obtains a read image; a background member which is provided in a position which is to be a background of the sheet when the sheet is read by the reader; and a hardware processor, wherein, the hardware processor extracts sheet outline information of the sheet from the read image and measures a misalignment of a position of the image with relation to the sheet based on the extracted sheet outline information, the hardware processor performs control based on a measured result of the misalignment of the position of the image, and the hardware processor adjusts a degree of control performed based on the measured result of the misalignment of the position of the image according to a density difference between the sheet and the background member.

According to another aspect, an image forming apparatus which operates in coordination with the image inspection apparatus, the image forming apparatus including: an image former which prints on a sheet an image including a position adjustment image used when the hardware processor performs the measurement, which selects a color material with a largest density difference from the sheet from among the color materials which can be used in the image forming apparatus when the position adjustment image is printed, and which prints the position adjustment image.

According to another aspect, a control method used in an image inspection apparatus including a reader which reads a sheet in which an image is printed, which reads the sheet together with a background, and which obtains a read image; a background member which is provided in a position which is to be a background of the sheet when the sheet is read by the reader; and a hardware processor which extracts sheet outline information of the sheet from the read image, which measures a misalignment of a position of the image with relation to the sheet based on the extracted sheet outline information, and which performs control based on a measured result of the misalignment of the position of the image, the method including: adjusting a degree of control performed based on the measured result of the misalignment of the position of the image according to a density difference between the sheet and the background member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention, wherein.

DETAILED DESCRIPTION OF THE EMBODIMENTS

Hereinafter, one or more embodiments of the present invention will be described with reference to the drawings. However, the scope of the invention is not limited to the disclosed embodiments.

Hereinafter, embodiments of the present invention are described in detail with reference to the drawings. However, the scope of the invention is not limited to the disclosed embodiments.

[Configuration of Image Forming Apparatus]

A configuration of an image forming apparatus 100 according to an embodiment of the present invention is described.

Figure 1:
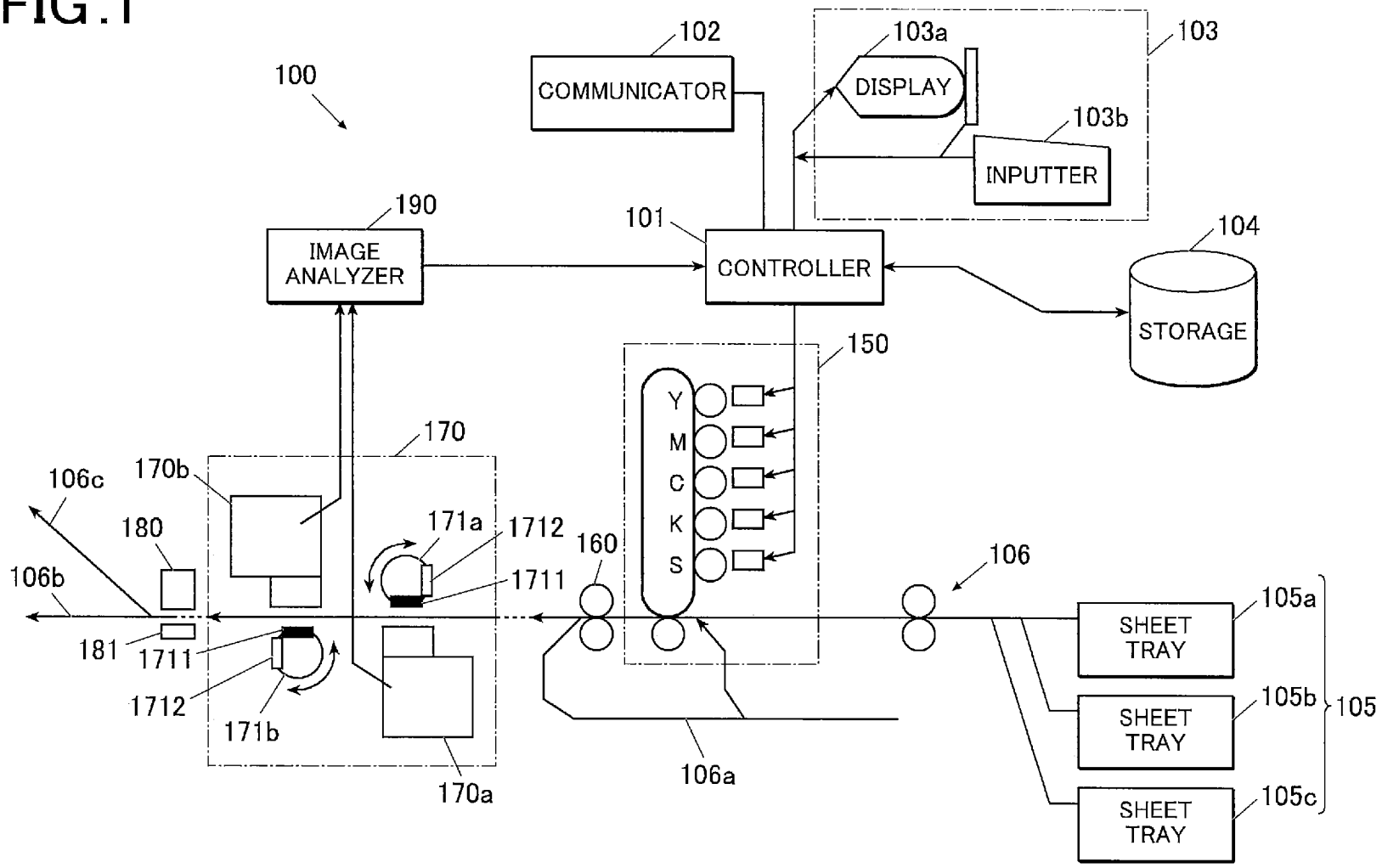
FIG. 1 is a block diagram showing a configuration of an image forming apparatus.

FIG. 1 is a diagram showing a main configuration of the image forming apparatus 100.

As shown in FIG. 1, the image forming apparatus 100 includes a controller 101 (hardware processor), a communicator 102, an operation and display interface 103, a storage 104, a sheet feeder 105, a conveyor 106, an image former 150, a fixer 160, a reader 170, a colorimeter 180, an image analyzer 190, and the like.

The controller 101 includes a CPU (Central Processing Unit), a ROM (Read Only Memory), a RAM (Random Access Memory), and the like. The CPU of the controller 101 reads a program according to contents of a process from the ROM and deploys the program in the RAM. In coordination with the deployed program, the CPU of the controller 101 centrally controls the operation of each unit in the image forming apparatus 100.

For example, the communicator 102 includes a communication control card such as a LAN (Local Area Network) card, etc., and performs transmitting and receiving of various data with external devices connected to the communication network such as the LAN, WAN (Wide Area Network), etc The operation and display interface 103 includes a display 103*a* such as a liquid crystal display or an organic EL display, and an inputter 103*b* including various operation keys, a touch panel positioned overlapped on a screen of the display 103*a*, numeric keys, and the like. The operation and display interface 103 displays various information on the display 103*a*. The operation and display interface 103 converts input operation by a user (operator) on the inputter 103*b* to an operation signal and outputs the operation signal to the controller 101.

For example, the storage 104 includes a nonvolatile semiconductor memory (so-called flash memory), hard disk drive, or the like. The storage 104 stores various data such as various setting information regarding the image forming apparatus 100 and job information (setting information of the job and image data of the job). The job setting information includes information regarding sheet trays 105*a* to 105*c* used in the job for each page, sheet color, sheet size, sheet type, total number of printed sheets, information of the adjustment function executed simultaneously with or in coordination with the job, and the like.

The storage 104 stores information regarding sheets set in the sheet trays 105*a* to 105*c* (size, color (density), type, etc.).

The storage 104 stores parameters used in a later described control based on a measured result of a misalignment amount of an image position. Such control corresponds to when the density difference between the sheet and the background members 171*a*, 171*b* is a later-described predetermined value B0 or more, or when the above density difference is less than the predetermined value B0.

The sheet feeder 105 feeds the sheets stored in the sheet trays 105*a* to 105*c* according to an instruction from the controller 101.

The conveyor 106 includes a sheet passing path and a plurality of conveying roller pairs such as a registration roller pair. The conveyor 106 conveys the sheet fed from the sheet feeder 105 within the image forming apparatus 100. The conveyor 106 includes a reversing path 106*a*, and the conveyor 106 is able to reverse the front and the back of the sheet and convey the reversed sheet to the image former 150. The conveyor 106 includes a sheet ejecting path 106*b* which ejects printed material and a sheet ejecting path 106*c* which ejects waste paper.

The image former 150 prints an image on the sheet based on the setting information of the job and the image data, and generates the printed material. According to the present embodiment, the image former 150 includes image forming units for each color of Y (yellow), M (magenta), C (cyan), K (black), and S (special color, white according to the present embodiment). In addition to images using toner in the usual colors such as Y, M, C, K, printing using white color toner is possible.

The fixer 160 fixes the image printed on the sheet with the toner by using heat and pressure.

According to FIG. 1, the image former 150 is illustrated as a so-called electrophotographic image former, but the method of printing is not limited to the above. For example, an image former using other printing methods such as an inkjet method can be employed.

The reader 170 reads printed material printed by the image former 150 and fixed by the fixer 160, and obtains read image data (read image). The obtained read image data is output to the image analyzer 190. The reader 170 includes a color scanner for example. The reader 170 is positioned on a downstream side of the image former 150 and the fixer 160, and reads the image while the sheet is conveyed.

The reader 170 includes a reader 170*a* which reads the image on one surface of the sheet and obtains the read image, and a reader 170*b* which reads the image on the other surface of the sheet and obtains the read image. According to the present embodiment, the reader 170*b* reads one printed surface of single-sided printing (front surface of double-sided printing) and the reader 170*a* reads the back surface of the double-sided printing, but the configuration is not limited to the above.

In each of the reader 170*a* and the reader 170*b*, a background member 171*a* and a background member 171*b* are provided in opposite positions with the sheet passing path in between. As shown in FIG. 1, for example, background members 171*a* and 171*b* include two surfaces with different densities (black color surface 1711, and white color surface 1721). By rotating the surface by a driving source (not shown), a background surface when the sheet is read (surface opposing to the corresponding reader) can be switched to black or white. That is, the background members 171*a* and 171*b* are configured to be able to switch the density. According to the present embodiment, the background members 171*a* and 171*b* are set in the background surface with the same density.

The read size read by the reader 170 is larger than the sheet size. The reader 170 is able to read a range larger than the sheet size including the outline of the sheet and the range of the background member near the sheet outline.

The colorimeter 180 is provided on the downstream side of the reader 170 in the sheet conveying direction. The colorimeter 180 includes a spectral colorimeter, etc. and is able to measure the color with high precision. A background member 181 is positioned in the colorimeter 180 with a sheet passing path in between. For example, the background member 181 includes a white color.

The image analyzer 190 analyzes the read image output by the reader 170, and calculates the amount of misalignment of the position of the images (image contents) printed on the front surface and the back surface of the sheet (image position misalignment amount) with relation to the sheet. The image analyzer 190 also calculates the color adjustment value. The above values are output to the controller 101. For example, the function of the image analyzer 190 is executed by the CPU of the controller 101 in coordination with the program stored in the ROM.

The controller 101, the operation and display interface 103, the reader 170, and the image analyzer 190 are included in the image inspection apparatus according to the present invention. The controller 101 functions as the controller and the background member controller according to the present invention. The operation and display interface 103 functions as the setter, selector, inputter, and notifier according to the present invention. The controller 101 and the image analyzer 190 function as the measurer according to the present invention.

[Operation of Image Forming Apparatus]

Next, the operation of the image forming apparatus 100 is described.

As described above, it may be difficult to control switching the background surface of the background member 171*a* and background member 171*b* depending on the density of the sheet to be used in each page of the job. However, if the density is fixed when the reader 170*a* and the reader 170*b* read the sheet (background surface of the background members 171*a* and 171*b*), it may not be possible to accurately read the sheet outline from the read image depending on the density of the sheet used in the printing. In such situation, the misalignment of the image position is measured based on the relation of the position between the sheet outline and image (registration mark and image contents) in the read image reading the printed material. If the image position adjustment and inspection of the product are performed based on the measured result, problems such as excess adjustment being performed and excess waste paper being generated may occur.

According to the present embodiment, by adjusting the degree of the control performed based on the measured result of the misalignment of the image position according to the density difference between the sheet and the background members 171*a* and 171*b* (specifically, easing the degree of control when the density difference is smaller than the predetermined value B0 compared to when the density difference is equal to or more than the predetermined value B0), it is possible to reduce the problems that occur due to not obtaining the sheet outline accurately from the read image because of the density between the sheet and the background member being close.

Figure 2:
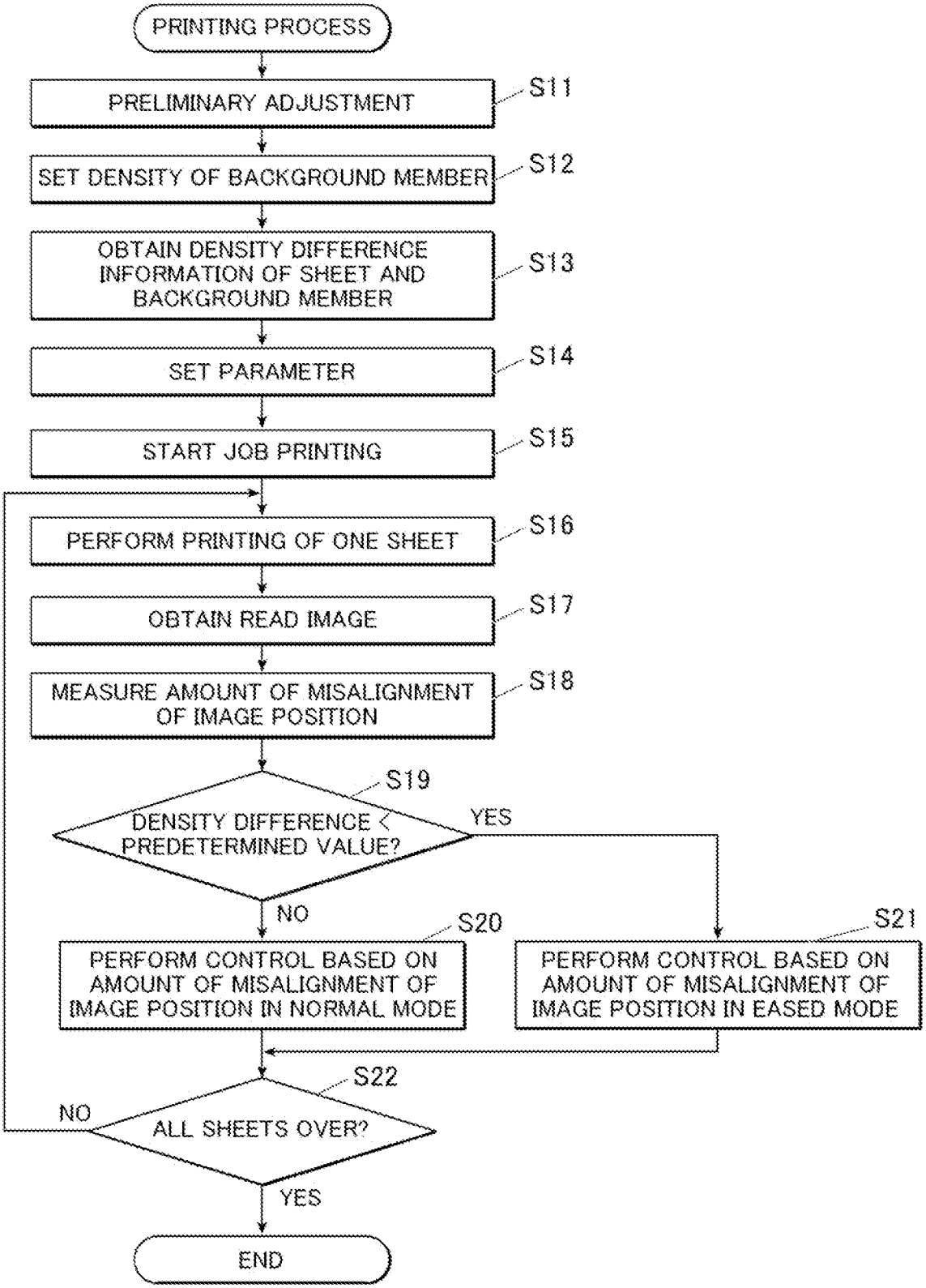
FIG. 2 is a flowchart showing a flow of a printing process executed by a controller shown in FIG. 1.

FIG. 2 is a flowchart showing a flow of a printing process executed by the controller 101. The printing process shown in FIG. 2 is executed by the CPU of controller 101 in coordination with the program stored in the RAM when the job is selected and the start of printing is instructed.

First, the controller 101 performs a preliminary adjustment of the image position on the front and the back (step S11).

The preliminary adjustment is the image position adjustment performed before printing based on the job so that printed material with the image printed in the correct position of the sheet from the beginning of printing can be obtained. The image position adjustment performed before printing based on the job is to be performed at least before performing the job performed right after the sheets in the sheet trays 105*a* to 105*c* are exchanged for the tray in which the sheets are exchanged. The image position adjustment does not have to be performed before each time the job is executed.

Figure 3:
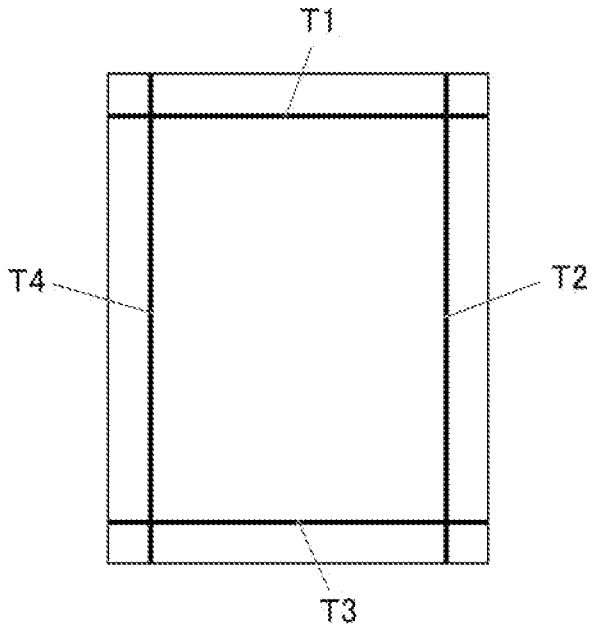
FIG. 3 is a diagram showing an example of a registration mark used in preliminary adjustment.

In the preliminary adjustment, first, the image former 150 applies position adjustment images (called registration marks) T1 to T4 shown in FIG. 3 at a preset distance toward the inner side from the four edges of the sheet with the type used in the printing of the job (for example, 10 mm from the sheet edge), and the image former 150 prints the front and the back of the sheet. The printed material is read by the reader 170*a* and the reader 170*b*. The obtained read image is analyzed by the image analyzer 190 and the sheet outline is extracted. With this, the relation of the positions (distance) between the sheet edge and the registration marks T1 to T4 is obtained. Then, the image analyzer 190 calculates adjustment values for a plurality of adjustment items so that the distance between the sheet edge and the registration marks T1 to T4 (the registration mark opposed to each sheet edge) in each of the front and the back is a predetermined distance. The above values are stored in the storage 104.

Depending on the color of the sheet which is the target of adjustment, the controller 101 sets the background surface of the background members 171*a* and 171*b* facing the reader 170*a* and the reader 170*b* respectively to the black color surface 1711 or the white color surface 1712. Then, the controller 101 allows the reader 170*a* and the reader 170*b* to perform the reading. For example, a black color surface 1711 is set as the background surface when the sheet is white and a white color surface 1712 is set as the background surface when the sheet is black. When the sheet color is a color other than white or black, the background surface with the color with which reading can be easily performed or with which reading can be performed (for example, the color with the larger density difference from the sheet) is suitably selected and set as the background surface from the black color surface 1711 or the white color surface 1712. Preferably, when the image former 150 prints the registration marks T1 to T4, the color material with the density which can be easily discriminated from the used sheet (color material in which the density difference with the sheet is a predetermined threshold or more), for example, white toner or white ink if the sheet is black is selected and the printing is performed. With this, it is possible to measure the misalignment of the image position with higher accuracy.

The preliminary adjustment can be repeated a plurality of times to enhance the accuracy and stability of the measurement. Alternatively, a plurality of sheets with the registration marks T1 to T4 applied may be printed as the printed material. Then, the adjustment values can be calculated and the average value of the values can be used.

The adjustment items calculated in the image position adjustment including the preliminary adjustment include vertical and horizontal magnification, vertical and horizontal image shift, rotation, skew, vertical trapezoid, horizontal trapezoid, curve, curved position, and the like. The adjustment values of the above adjustment items can be obtained independently. Among the above adjustment items, the image position of the four corners can be adjusted by the adjustment of the following adjustment items including, magnification, image shift, rotation, skew, vertical trapezoid and horizontal trapezoid. Moreover, the curve and the curved position is for adjusting the distortion of the image. By using the above together, a more advanced image position adjustment is possible.

Figure 4A:
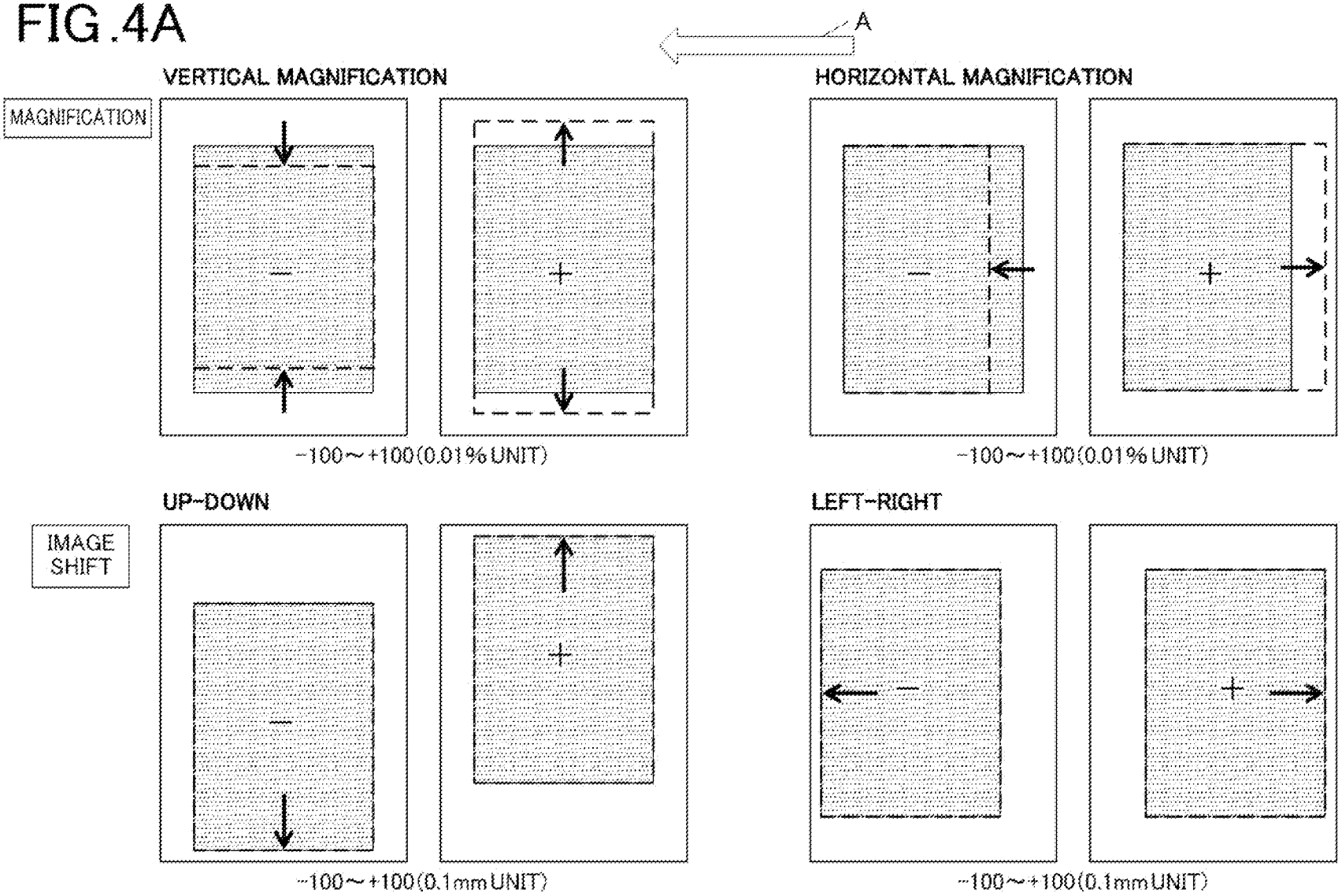
FIG. 4A is a diagram showing ranges of adjustment values in each adjustment item including vertical magnification, horizontal magnification, vertical image shift, horizontal image shift, and examples of the adjustments.
Figure 4B:
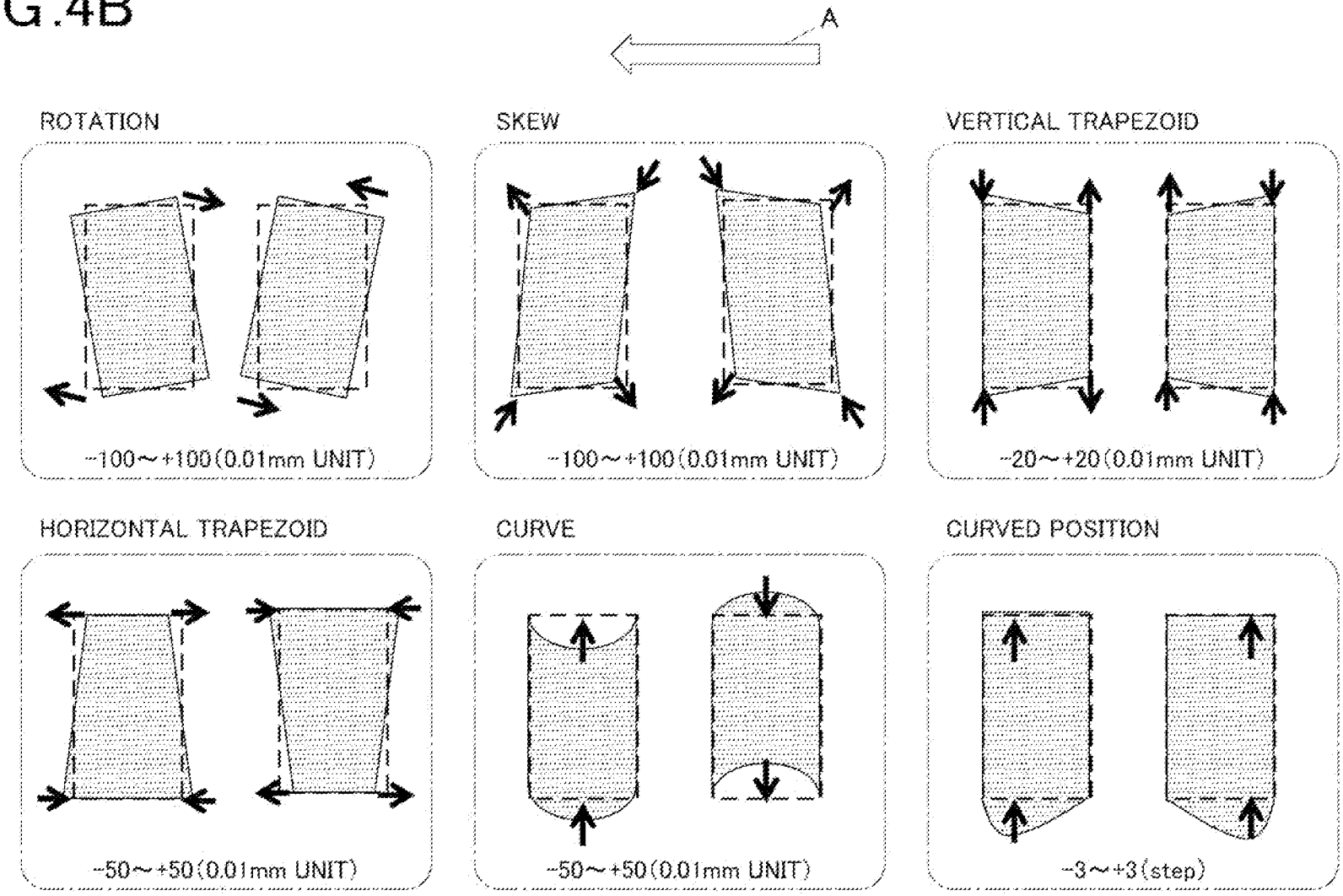
FIG. 4B is a diagram showing ranges of adjustment values in each adjustment item including rotation, skew, vertical trapezoid, horizontal trapezoid, curve, and curved position.

FIG. 4A shows the range of the adjustment value and the examples of the adjustment for the following adjustment items including vertical magnification, horizontal magnification, vertical image shift and horizontal image shift. FIG. 4B shows the range of the adjustment value and the examples of the adjustment for the following adjustment items including rotation, skew, vertical trapezoid, horizontal trapezoid, curve and curved position. The bold arrow A shown in FIG. 4A and FIG. 4B show a sheet conveying direction. The solid line shows the sheet, the dotted line shows the target image position, the hatching shows the present image position, and the thin arrow shows the direction that the image moves by adjustment. In the image shift shown in FIG. 4A, since it becomes difficult to see if both the present image position and the target position are shown, both are shown to be the same and only the direction that the image moves for adjustment is shown. In FIG. 4B, the solid line showing the sheet is omitted.

According to the present embodiment, in the preliminary adjustment, the sheet in which the registration marks T1 to T4 are printed is read by the reader 170, and the obtained read image is analyzed by the image analyzer 190. With this, the adjustment values of the adjustment items shown in FIG. 4A and FIG. 4B are automatically obtained. Alternatively, the sheet in which the registration marks T1 to T4 are printed may be observed by sight by the user and the adjustment values of the adjustment items can be determined. The determined adjustment values can be input on the operation and display interface 103 and the value of the adjustment values can be obtained.

In the preliminary adjustment in step S11, in addition to the image position, the color adjustment (calibration, output sheet density adjustment) can be performed.

Figure 5:
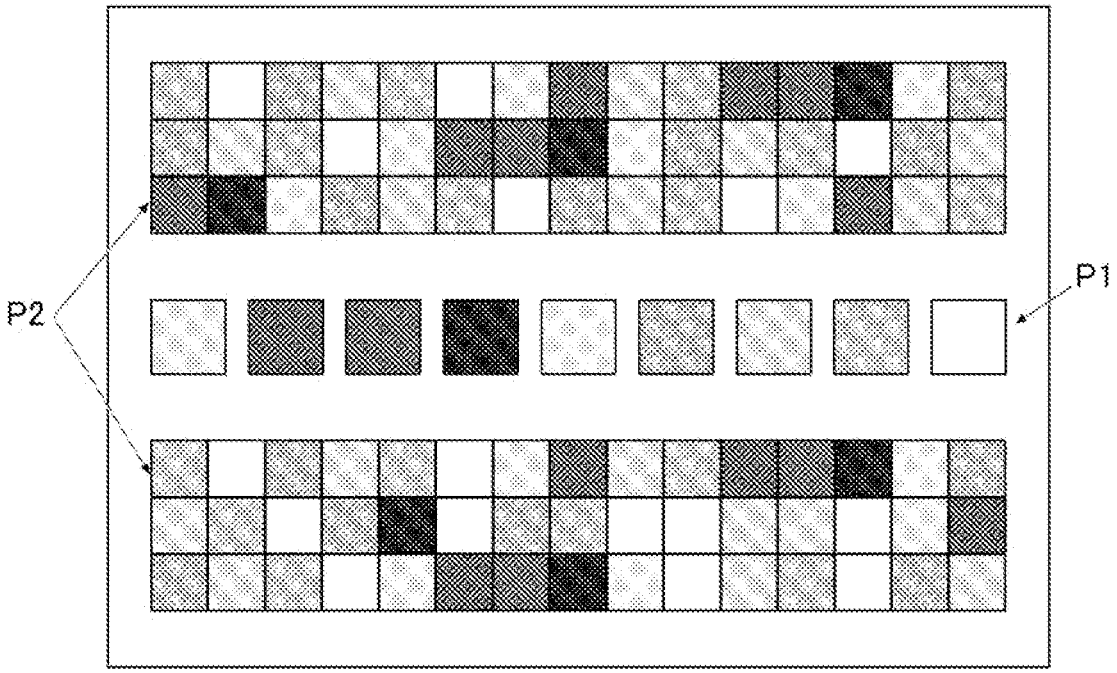
FIG. 5 is a diagram showing an example of a calibration chart.

The calibration in printing is performed for the purpose of adjusting the finished color tone to be the same as the offset printing by ink when the printing is performed with the electrophotographic type toner based on the image data created for printing with ink for offset printing. For example, the calibration chart (one sided chart) as shown in FIG. 5 including the plurality of patches in which the combination of the tone values is determined in advance is printed on the sheet, and the printed result is measured. With this, the so-called color profile for adjusting the color tone of the printed image is created. When the printing is performed based on the job, the created color profile is applied in order to manage the color tone of the printed image. There are many existing methods for managing the color tone. However, such methods assume that the patches of the calibration chart are read correctly. Therefore, a dedicated colorimeter 180 with which the correct read value can be obtained is positioned near the reader 170 (here, reader 170*b*), the patch P1 is read using the colorimeter 180 and the reader 170*b* which reads the printed surface in one-sided printing, and a conversion formula is calculated to convert the read value of the reader 170*b* to the read value of the colorimeter 180. Further, the patch P2 including various tone values is read by the reader 170*b*, and based on the measured value and the above conversion formula, the calibration is performed, the color profile is generated, and the result is stored in the storage 104.

In such calibration, it is important that the surface facing the colorimeter 180 of the background member 181 and the background surface of the background member 171*b* match to be white. The controller 101 sets the background surface of the background member 171*a* and the background member 171*b* to be white and the above calibration is performed.

Normally, the color management of printed materials in the electrophotographic method is controlled by the toner amount of the toner image which is transferred on the intermediate transfer belt and which is detected by the image sensor provided facing the intermediate transfer belt. In this case, the actual printed result on the printed material changes depending on a transfer efficiency when the toner image is transferred on the sheet and the quality of the color generation of the toner on the sheet. In order to perform the color management more accurately, there is a method to read the image printed on the sheet with the reader 170, and to manage the color of the printed material according to the tone value. This is called output sheet density adjustment.

The output sheet density adjustment is performed by the following three steps.

<Step A>

First, similar to the above-described calibration, a color patch (patch P1) the same as the calibration chart is read by the colorimeter 180 and the reader 170*b*. The read values are compared, and a conversion formula to convert the read value of the reader 170*b* to the read value of the colorimeter 180 is generated.

<Step B>

By using the conversion formula in step A, the read result of the patch P2 of the calibration chart read by the reader 170*b* is converted. Based on the obtained measured result, a tone conversion table (or a space look up table (LUT) with the similar effect) is created and stored in the storage 104. This is to be a color management state before starting the job.

<Step C>

While the job is performed, the color patch for inspection is printed in the surrounding portion of the image (cut off portion) on the sheet or a region in the image printed by the job (image contents) which can be used for color inspection is specified, and the color patch for inspection or the specified region is read by the reader 170*b*. In order to reduce the variation in the read result, the process conditions during printing and the conversion of the tone conversion properties in the printed image are converted (converted to the tone conversion table or space LUT), and the color tone is managed.

If the output sheet density adjustment is performed, step A to step B are performed in step S11 shown in FIG. 2, and step C is performed during the job.

The goal of the output sheet density adjustment is to maintain the color tone at present regardless of the present color tone (for example, suppress change in color tone during the job). Therefore, background surface of the background member 171*b* can be white or black, but the necessary condition is to always use the same surface throughout step A to step C. In step C, during the job of double-sided printing, the region of the image contents may be specified and the change in the read result may be calculated. If the background color is white, the image of the back surface may appear as noise. Typically, a white sheet is mostly used. Therefore, preferably, the background color is black so that the outline of the white sheet is easily read. If the output sheet density adjustment is performed, preferably, the background surface of the background member 171*a* and the background member 171*b* is set to black.

Next, the controller 101 sets the density of the background surface of the background members 171*a* and the 171*b* to the density while the job is performed (step S12).

For example, according to the adjustment function performed simultaneously or in conjunction with the job, the density of the background surface of the background member 171*a* and the background member 171*b* is set (control of switching).

For example, when the output sheet density adjustment is performed, as described above, the background surface of the background member 171*a* and the background member 171*b* is set to black.

For example, when the calibration by the colorimeter 180 is also performed, together with performing the calibration, the background surface of the background member 171*a* and the background member 171*b* is set to white.

For example, among the sheets set in the sheet trays 105*a* to 105*c*, the density of the background surface of the background members 171*a* and 171*b* can be set based on the configuration of the sheet set in the sheet tray used in the job.

For example, the density of the background surface of the background members 171*a* and 171*b* is set to be suitable for the sheet which is used most in the job. For example, a sensor which measures the sheet color (or density) is provided in the image forming apparatus 100 (for example, in the sheet tray). The density of the sheet in the sheet tray is obtained based on the measured result measured by the sensor. The surface (black surface 1711 or white surface 1712) with the larger density difference from the sheet in the sheet tray with the largest number of sheets used in the job is set as the background surface of the background members 171*a* and 171*b*. The sheet color (or the density converted from each tone value of RGB) may be measured using the tone value of the read image of the readers 170*a* and 170*b* instead of the sensor.

Alternatively, the sheet for monitoring the misalignment of the position of the image while the job is performed (attribute of the sheet, etc.) can be selected by the user on the inputter 103*b*, and the density of the background surface of the background members 171*a* and 171*b* can be set so that the density of the background members 171*a* and 171*b* while the job is performed is the density suitable for the sheet selected on the inputter 103*b* (the surface (black surface 1711 or white surface 1712) with the larger density difference from the selected sheet is set as the background surface of the background members 171*a* and 171*b*).

According to the above configuration, the print management with a higher degree of accuracy is performed with the sheet which is printed in larger numbers or with the sheet in which the user considers the quality is important. With this, the management contributes to enhancing the quality of the entire job.

Alternatively, the density of the background members 171*a* and 171*b* can be instructed by the user on the inputter 103*b*, and the density of the background surface of the background members 171*a* and 171*b* can be set to be the density instructed by the inputter 103*b*. With this, the density can be set to the density desired by the user.

Next, the controller 101 obtains density difference information of the sheet and the background members 171*a* and 171*b* (step S13).

When a plurality of sheet trays are used in the job, the sheet color in each sheet tray may be different and the density difference information is obtained for each sheet tray used in the job (for each sheet in the sheet tray).

For example, the density difference information can be obtained by obtaining the density of the sheet set in the sheet tray from the measured result of the sensor dedicated to measuring the above described sheet color (or density), and calculating the density difference from the background surface set in step S12. As the density, an optical density based on reflectance may be used or a density converted from the tone value of each color in RGB can be used. For example, if the measured result of the sensor is a color, the measured result can be converted to the density and the density difference from the background surface set in step S12 is calculated. The density of the background surface can be measured in advance for when the background surface is white and when the background surface is black, and the result can be stored in the storage 104.

Alternatively, the density difference between the sheet set in each sheet tray and the background members 171*a* and 171*b* can be specified by the user on the inputter 103*b* in a form included in the information regarding the sheet set in the sheet tray (stored in the storage 104). In this case, the density difference can be specified as a numeric value, or the user can specify that the density difference is large or small. When the density difference is specified to be large, the controller 101 obtains the density difference information to be the value larger than the later-described predetermined value B0 (for example, 100). When the density difference is specified to be small, the controller 101 obtains the density difference information to be the value smaller than the later-described predetermined value B0 (for example, 10).

Next, the controller 101 sets the parameter used in the control performed based on the measured result of the misalignment amount of the image position in the printed material (step S14).

In step S14, the density difference information is referred for each sheet used in the job, and the parameter according to the density difference between the sheet and the background member is set.

As the control performed based on the measured result of the misalignment amount of the image position, for example, there is inspection of the product or image position adjustment.

In the inspection of the product, it is determined whether the measured misalignment amount of the image position exceeds a defective product determining threshold determined in advance. If the amount does not exceed the defective product determining threshold, the printed material is determined to be good (the misalignment of the position with relation to the sheet is small) and the printed material is ejected from the normal sheet ejecting path 106*b*. If it is determined to exceed the defective product determining threshold, the printed material is determined to be the defective product and the following processes (1) to (3) are performed.

(1) The printed material is ejected as waste paper from the sheet ejecting path 106*c* and printed again.

(2) A warning that the misalignment of the image position is occurring is displayed on the display 103*a*.

(3) The mode automatically switches to maintenance mode.

Here, as the defective product determining threshold, the storage 104 stores a threshold th11 corresponding to when the density difference between the sheet and the background member is a predetermined value B0 set in advance or more, and a threshold th12 corresponding to when the density difference is less than the predetermined value B0 set in advance (threshold th11<threshold th12). The predetermined value B0 is a value obtained by experiments or by experience and shows the value that the extracting of the sheet outline information in the read image may fail if the density difference is smaller than the value. In step S14, when the control based on the measured result of the misalignment amount of the image position is inspection of the product, the defective product determining threshold (threshold th11 or th12) is set as the parameter for each sheet according to the density difference between the sheet and the background member.

According to the image position adjustment, the adjustment value is calculated based on the measured misalignment amount of the image position. The adjustment value is calculated based on the measured result of the misalignment amount of the image position, and the parameters such as the gradient that defines the upper limit of the adjustment value (adjustment amount) for each elapsed amount of time in printing (number of printed sheets), and the number of sheets of the printed material (average number of sheets, number of sheets showing the number of sheets of the printed material that are obtained to average the read result and obtain the adjustment value), the number of sheets being a number employed for calculating the adjustment value. Here, as the gradient defining the upper limit of the adjustment value for each elapsed amount of time in printing (number of printed sheets), the storage 104 stores a gradient g11 corresponding to when the density difference between the sheet and the background member is equal to or more than the predetermined value B0 set in advance and a gradient g12 corresponding to when the density difference is less than the predetermined value B0 set in advance (gradient g11>gradient g12). As the average number of sheets of the printed material used in the calculation of the adjustment value, the storage 104 stores the average number of sheets P11 corresponding to when the density difference between the sheet and the background member is equal to or more than the predetermined value B0 set in advance and the average number of sheets P12 corresponding to when the density difference is less than the predetermined value B0 set in advance (average sheet number P11<average sheet number P12). In step S14, when the control based on the measured result of the misalignment amount of the image position is the image position adjustment, as the parameter for each sheet, according to the density difference between the sheet and the background member, the gradient (gradient g11 or g12) defining the upper limit of the adjustment value for each elapsed amount of time in printing (number of sheets) and the average number of sheets (P11 or P12) of the printed material used in the calculation of the adjustment value are set. The parameters may be set for each adjustment item.

Next, the controller 101 starts the printing based on the job (step S15), and performs the printing of one sheet (step S16).

Figure 6:
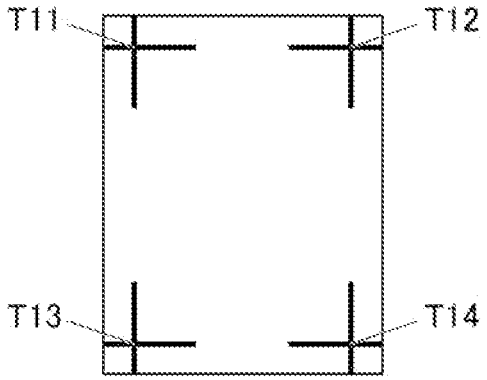
FIG. 6 is a diagram showing an example of a registration mark used in image position adjustment during a job.

In step S16, first, the controller 101 performs the image process on the image data of the target to be printed (for example, rasterizing process, process based on the color conversion or tone conversion table using the color profile stored in the storage 104). Next, the controller 101 controls the image former 150 and the conveyor 106 and the image contents based on the image data is drawn on the printing region on the sheet. The image with the registration marks T11 to T14 (see FIG. 6) attached to the margin of the sheet (predetermined distance from the sheet edge) is printed on the sheet, and the image is fixed by the fixer 160. Here, based on the adjustment value of each adjustment item stored in the storage 104, the position of the image printed on the sheet is adjusted. When the double-sided printing is performed, the controller 101 controls the conveyor 106 and the image former 150 and the double-sided printing is performed. Preferably, when the registration marks T11 to T14 are printed by the image former 150, the used sheet and the color material with the density that can be easily identified (color material in which the density difference with the sheet is equal to or larger than the predetermined threshold), for example white toner or white ink for a black sheet is selected and printing is performed. With this, it is possible to measure the misalignment of the image position with higher accuracy.

Next, the controller 101 controls the reader 170 to read the printed sheet (printed material) and obtains the read image including the sheet outline and the background (background member) (step S17).

In double-sided printing, each of the reader 170*a* and the reader 170*b* reads each surface of the printed material, and obtains the read image of both surfaces. In one-sided printing, the reader 170*b* reads the printed surface of the printed material and obtains the read image of one side. Here, the read image is obtained with tone values of RGB.

Next, the controller 101 controls the image analyzer 190 to perform the analysis of the read image, and measures the misalignment amount of the image position with relation to the sheet (step S18).

In step S18, the controller 101 controls the analyzer 190 to extract the sheet outline information and the registration marks T11 to T14 from the obtained read image and obtains the distance between the sheet edge on four sides of the sheet outline and the corresponding registration marks T11 to T14. Then, based on the obtained distance, the misalignment amount of the image position is measured with relation to the sheet.

The above-described density difference information can be obtained by analyzing the read image obtained in step S17 by the image analyzer 190. Then, based on the density difference information obtained based on the read image, the parameter used in the control based on the result of measuring the misalignment amount of the image position may be set. In this case, the obtaining of the density difference information and the setting of the parameter are performed after step S17. As the density, the tone value output from the reader 170 (tone value of the read image) or the converted value is used.

Next, the controller 101 refers to the obtained density difference information and determines whether the density difference between the density of the sheet and the density of the background member is smaller than the predetermined value B0 (step S19).

When the density difference between the density of the sheet and the density of the background member is determined to be equal to or larger than the predetermined value B0 (step S19; NO), the controller 101 performs the control based on the result measuring the amount of misalignment of the image position in the normal mode (step S20), and proceeds to step S22.

When it is determined that the density difference between the density of the sheet and the density of the background member is smaller than the predetermined value B0 (step S19; YES), the controller 101 performs the control based on the result of measuring the misalignment amount of the image position in an eased mode (step S21) and proceeds to step S22.

Here, as the control based on the result of measuring the misalignment amount of the image position, as described above, there is the inspection of the product or image position adjustment.

When the density difference between the density of the sheet and the density of the background member is smaller than the predetermined value B0, the sheet outline is difficult to detect from the read image, and it may not be possible to extract the accurate sheet outline information from the read image. When the sheet outline information is not accurate, the misalignment amount of the image position measured based on the relation of the positions between the sheet outline information and the registration mark printed on the sheet is also not accurate. If the control is performed reflecting the misalignment amount of the image position which is not accurate as is, adjustment, exclusion of the printed material, and warnings are generated excessively.

The controller 101 adjusts the degree of control performed based on the result of measuring the misalignment amount of the image position based on the density difference between the density of the sheet and the density of the background member (degree of the strictness of inspection of the product (strictness of the determination for defective products) or the degree of adjustment in the image position adjustment). Specifically, when it is determined that the density difference between the density of the sheet and the density of the background member is smaller than the predetermined value B0, the degree of control performed based on the result of measuring the misalignment amount of the image position is eased compared to when it is determined that the density difference is equal to or larger than the predetermined value B0. Hereinbelow, the inspection of the product and the image position adjustment are described.

(Inspection of Product)

Figure 7:
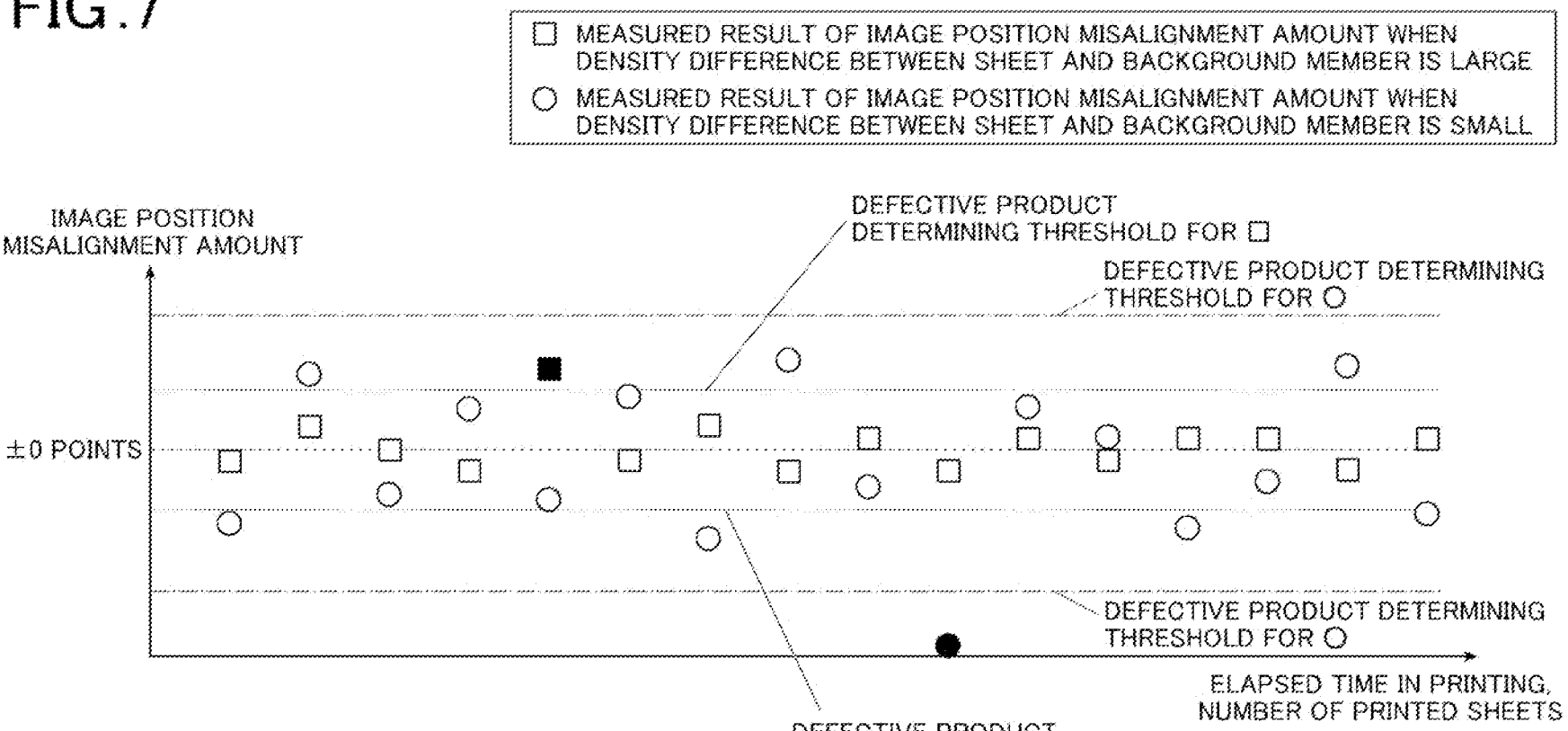
FIG. 7 is a graph showing a relation of variation of a misalignment amount of the image position and a threshold to determine a defective product when a density difference between the sheet and the background member is large and when the density difference is small.

FIG. 7 is a graph plotting the misalignment amount of the image position for each printing progress with the vertical axis showing the misalignment amount of the image position and the horizontal axis showing the elapsed amount of time in printing (printed number of sheets).

As shown in FIG. 7, if the density difference between the sheet and the background member is large (when the predetermined value is B0 or more (square)), the variation of the measured result of the misalignment amount of the image position is small. If the density difference between the sheet and the background member is small (smaller than predetermined value B0 (circle)), the variation in the measured result of the misalignment amount of the image position becomes large. Therefore, if the defective product determining threshold to determine the defective product is set to the same value as when the variation is small, it is frequently determined to be the defective product. Consequently, the waste sheet is ejected excessively and the warning is performed. If the density difference between the sheet and the background member is smaller than the predetermined value B0, the inspection of the product is performed with the eased mode which uses a defective product determining threshold larger than the normal mode. By performing the above, the defective product determining standard is eased so that the ejecting and notification of the defective product does not occur frequently.

Specifically, the inspection of the product is performed using the defective product determining threshold corresponding to the sheet of the printed material set in the upper steps (step S14 in FIG. 2). In the normal mode, the inspection of the product is performed with the defective product determining threshold as th11. In the eased mode, the inspection of the product is performed with the defective product determining threshold as th12 which is larger than th11.

As described above, the defective product determining threshold in the inspection of the product is controlled by the density difference between the sheet and the background member. Therefore, for example, if the sheets are supplied from a plurality of trays in one job, the defective product determining threshold changes depending on the supplied sheet. Normally, there is no problem with such control. However, when it is desired to manage the misalignment of the image position more strictly or to suppress the waste paper ratio to a minimum, the control as described below can be employed.

When it is Desired to Minimize the Ratio of Waste Paper

The defective product determining value of each sheet tray is confirmed, and the defective product determination which is eased the most (largest defective product determining threshold) is selected as the common defective product determining threshold.

When it is Desired to Manage the Misalignment of the Image Position More Strictly The defective product judging threshold set in the sheet for each sheet tray is confirmed, and separate from the above, the user is able to set the defective product judging threshold on the inputter 103*b*. The defective product judging threshold set by the user on the inputter 103*b* is used to perform the inspection of the product. Here, for the sheet in which the defective product judging threshold set by the user is smaller than the defective product judging threshold set with relation to the sheet (sheet tray), control may be performed so that the display 103*a* displays that there is a possibility that a large amount of waste sheets may be generated, and confirmation by the user is requested.

According to the above configuration, when the user sets the defective product judging threshold which is not suitable for the accuracy of the apparatus, it is possible to exclude or reduce the possibility of unintended operation.

According to the above description, one defective product determining threshold used is set for each of the normal mode and the eased mode according to the density difference between the sheet and the background member, but the present invention is not limited to the above. Alternatively, control can be performed also considering the progress of the measured result of the misalignment of the image position during the job.

Figure 8:
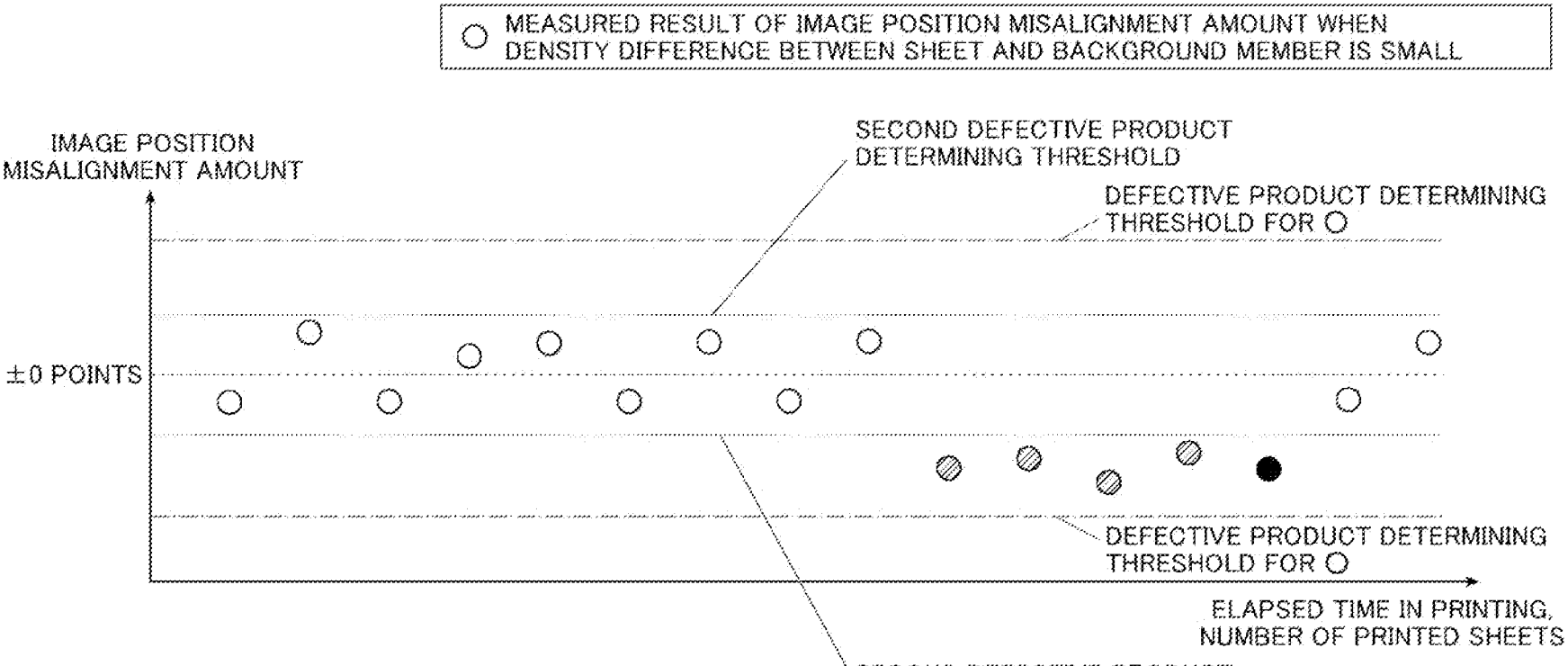
FIG. 8 is a diagram which describes determination of the defective product when two thresholds for determining the defective product are used.

For example, as shown in FIG. 8, the second threshold smaller than the above-described defective product determining threshold (first threshold) is set. After a situation in which misalignment of the image position does not occur in an amount exceeding the second threshold for a predetermined number of sheets C1 or more (9 sheets in FIG. 8), if the second threshold is exceeded successively for a predetermined number of sheets C2 or more (5 sheets in FIG. 8), the printed material in which the misalignment of the image position exceeding the second threshold occurred may be considered to be the defective product. In this case, in order to perform the determination of the defective product, the result of the predetermined number of sheets C2 needs to be monitored. When the second threshold is exceeded in a predetermined number of sheets C2 (point shown with a black circle in FIG. 8), the determination of the defective product is performed. From this point, going back, the printed material in which the second threshold is exceeded successively (circle with hatching in FIG. 8) is ejected as a defective product (waste sheet).

Alternatively, after the situation in which the misalignment of the image position exceeding the second threshold does not occur for a number of sheets equal to or more than the predetermined number of sheets C1 (9 sheets in FIG. 8), if even one sheet exceeds the second threshold, the printed material may be determined to be a defective product. Alternatively, the second threshold may be suitably changed according to the progress of printing. For example, if the variation in the amount of misalignment of the image position of the printed material gradually increases (or decreases) as the amount of time used in printing elapses, according to the above, control may be performed so that the second threshold is set to gradually increase (or decrease).

As described above, by performing control also considering the progress of the measured result of the misalignment of the image position in the job, the printing can be managed with high accuracy.

(Image Position Adjustment)

When the density difference between the sheet and the background member is small, as described above, the sheet outline information is not extracted accurately and may vary greatly. Therefore, if the measured result of the misalignment amount of the image position measured using the sheet outline is used as the adjustment value as is and the value is reflected in the image position adjustment, the image position may be unstable. When the density difference is smaller than the predetermined value B0, the image position adjustment is performed with the eased mode, and control in which reflecting the measured result of the misalignment amount of the image position to the image position adjustment is eased than when the density difference is a predetermined value B0 or more is performed. With this, the change in the image position due to the noise can be suppressed.

Specifically, the image position adjustment is performed using the gradient defining the upper limit of the adjustment amount corresponding to the sheet of the printed material and the average number of sheets set in the upper step (step S14 in FIG. 2). In the normal mode, the adjustment value is calculated with the gradient as g11 and the average number of sheets as P11. In the eased mode, the adjustment value is calculated with the gradient as g12 smaller than g11, and the average number of sheets as P12 larger than P11.

Figure 9A:
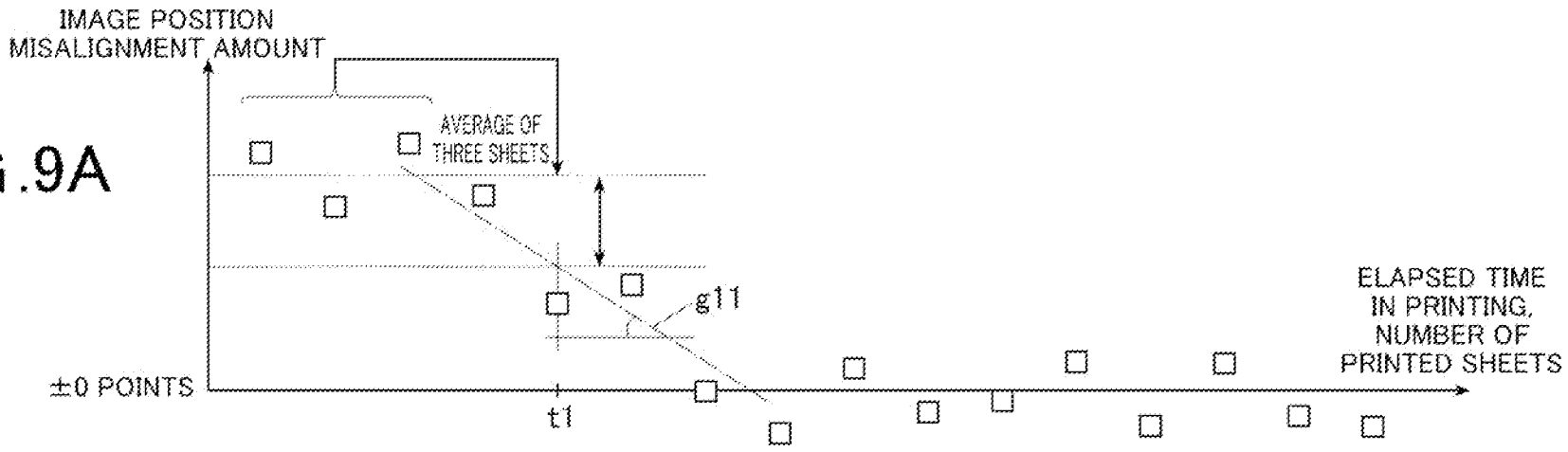
FIG. 9A and FIG. 9B are diagrams schematically showing image position adjustment when the density difference between the sheet and the background member is large and when the density difference is small.

FIG. 9A is a graph plotting the misalignment amount of the image position for each point in the progress of printing when the image position adjustment is performed in the normal mode when the density difference between the sheet and the background member is large (when equal to or larger than the predetermined value B0). The vertical axis is the misalignment amount of the image position and the horizontal axis is the elapsed amount of time in printing (printed number of sheets).

If the density difference between the sheet and the background member is large, the variation of measuring the misalignment amount of the image position for each sheet is small. Therefore, it is possible to correctly understand the misalignment of the present position by an average of a small number of sheets P11 (here, three sheets). In view of the above, the average number of sheets is to be three sheets, and the average misalignment amount of three sheets is calculated. Then, based on the average misalignment amount, the adjustment value is calculated with an upper limit of the adjustment value defined by the gradient g11 as the limit, and the adjustment value is applied in the next printing. The gradient g11 defining the adjustment value upper limit is shown with a gradient in a single-dotted chain line in FIG. 9A. The adjustment value upper limit applied at the point t1 is shown with an arrow.

Figure 9B:
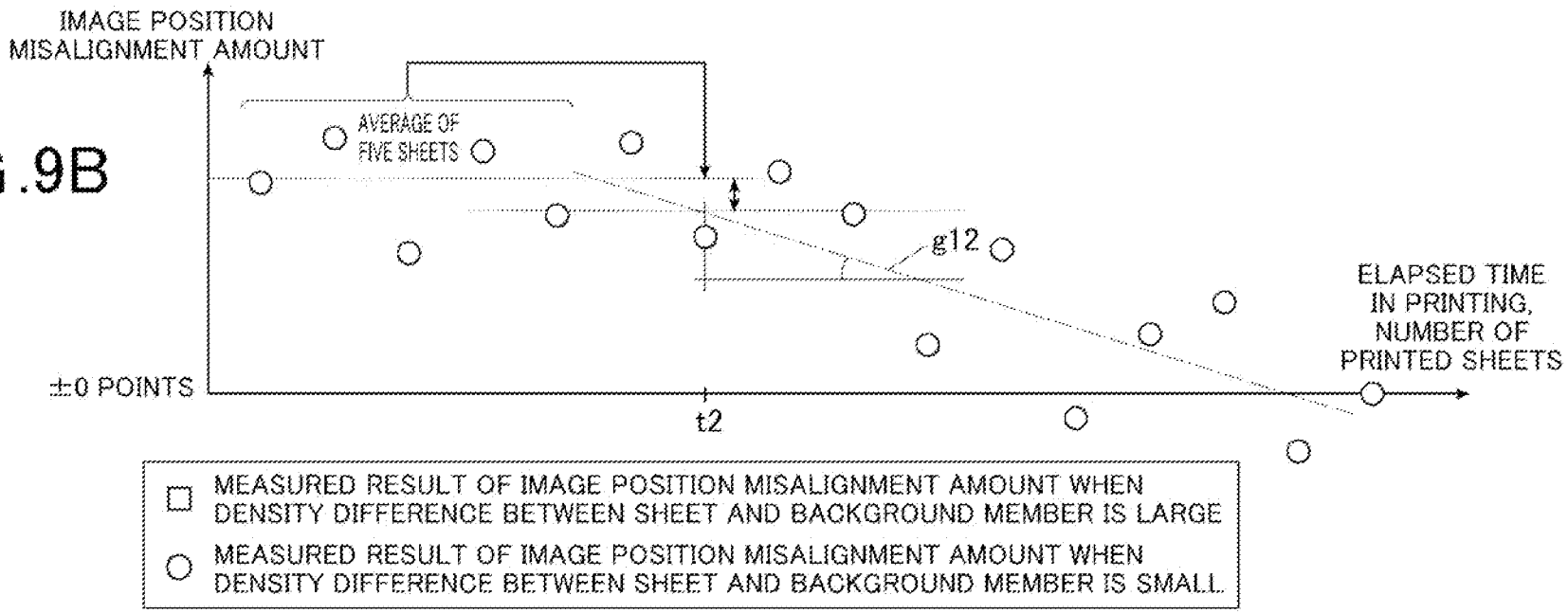

FIG. 9B is a graph plotting the misalignment amount of the image position for each point in the progress of printing when the image position adjustment is performed in the eased mode when the density difference between the sheet and the background member is small (less than the predetermined value B0). The vertical axis is the misalignment amount of the image position and the horizontal axis is the elapsed amount of time in printing (printed number of sheets).

When the density difference between the sheet outline and the background member is small, the variation in measuring the misalignment amount of the image position is large for each sheet. Therefore, it is necessary to understand the present misalignment of the position by obtaining an average with a larger number of sheets than the normal mode. In view of the above, the average misalignment amount is calculated using an average number of sheets obtained by a larger number of sheets P12 (here, five sheets). Then, based on the average misalignment amount, the adjustment value is calculated with an upper limit of the adjustment value defined by the gradient g12 as the limit, and the adjustment value is applied in the next printing.

The gradient g12 defining the adjustment value upper limit is shown with a gradient in a single-dotted chain line in FIG. 9B. The adjustment value upper limit applied at the point t2 is shown with an arrow. The gradient g12 defining the adjustment value upper limit is set to be smaller compared to the normal mode. According to the above, the degree of adjustment in the image position adjustment based on the inaccurate measured result of the misalignment of the image position can be reduced (eased), and even if there is a variation in the measurement of the misalignment of the image position in each sheet, it is possible to perform image position adjustment which hardly receives the influence of the variation.

When the output sheet density adjustment is performed, for example, based on the color of the predetermined region in the read image, the process progresses to step S22 after the process conditions in printing and the tone conversion curve is changed.

In step S22, the controller 101 determines whether the printing of all sheets is finished, and when it is determined that the printing of all sheets is not finished (step S22; NO), the process returns to step S16, and the processes in steps S16 to step S22 are executed in the next sheet.

When it is determined that the printing in all sheets is finished (step S22; YES), the controller 101 ends the printing process.

According to the printing process, the registration mark is printed in the sheet during the job and the misalignment amount of the image position is measured based on the distance between the registration mark and the sheet outline. However, the method to measure the misalignment amount of the image position is not limited to the above. For example, the controller 101 may predict the printed result when the image is printed based on the image data on the sheet used in printing based on the image data of the job and generate the image showing the predicted printed result as comparison image information. The controller 101 may calculate the misalignment amount of the position based on the relation of the positions of the sheet outline and the image contents in the generated comparison image information and the relation of the positions of the sheet outline and the image contents in the read image obtained by reading with the reader 170 the printed result when the image is actually printed on the sheet based on the image data of the job.

As described above, according to the image forming apparatus 100, the controller 101 extracts the sheet outline information with the image analyzer 190 from the read image obtained by the reader 170 reading the sheet in which the image is printed by the image former 150. The controller 101 measures the misalignment of the position of the image with relation to the sheet based on the extracted sheet outline information. The controller 101 performs control based on the measured result of the misalignment in the position of the image. Here, the degree of control performed based on the measured result of the misalignment in the position of the image is adjusted based on the density difference between the sheet and the background member. For example, when the density difference between the sheet and the background member is smaller than a predetermined value, the degree of the control performed based on the measured result of the misalignment in the position of the image is eased compared to when the density difference between the sheet and the background member is equal to or more than the predetermined value.

Therefore, it is possible to reduce the problems that occur when the sheet outline cannot be accurately obtained from the read image due to the density difference between the sheet and the background member being small.

The description of the above-described embodiments are preferable examples of the image inspection apparatus according to the present embodiment, and the present invention is not limited to the above.

For example, according to the present embodiment, the image inspection apparatus according to the present invention is configured as one with the image forming apparatus 100 (incorporated in the image forming apparatus 100). However, the image inspection apparatus according to the present invention may be configured as a separate apparatus from the image forming apparatus.

Figure 10:
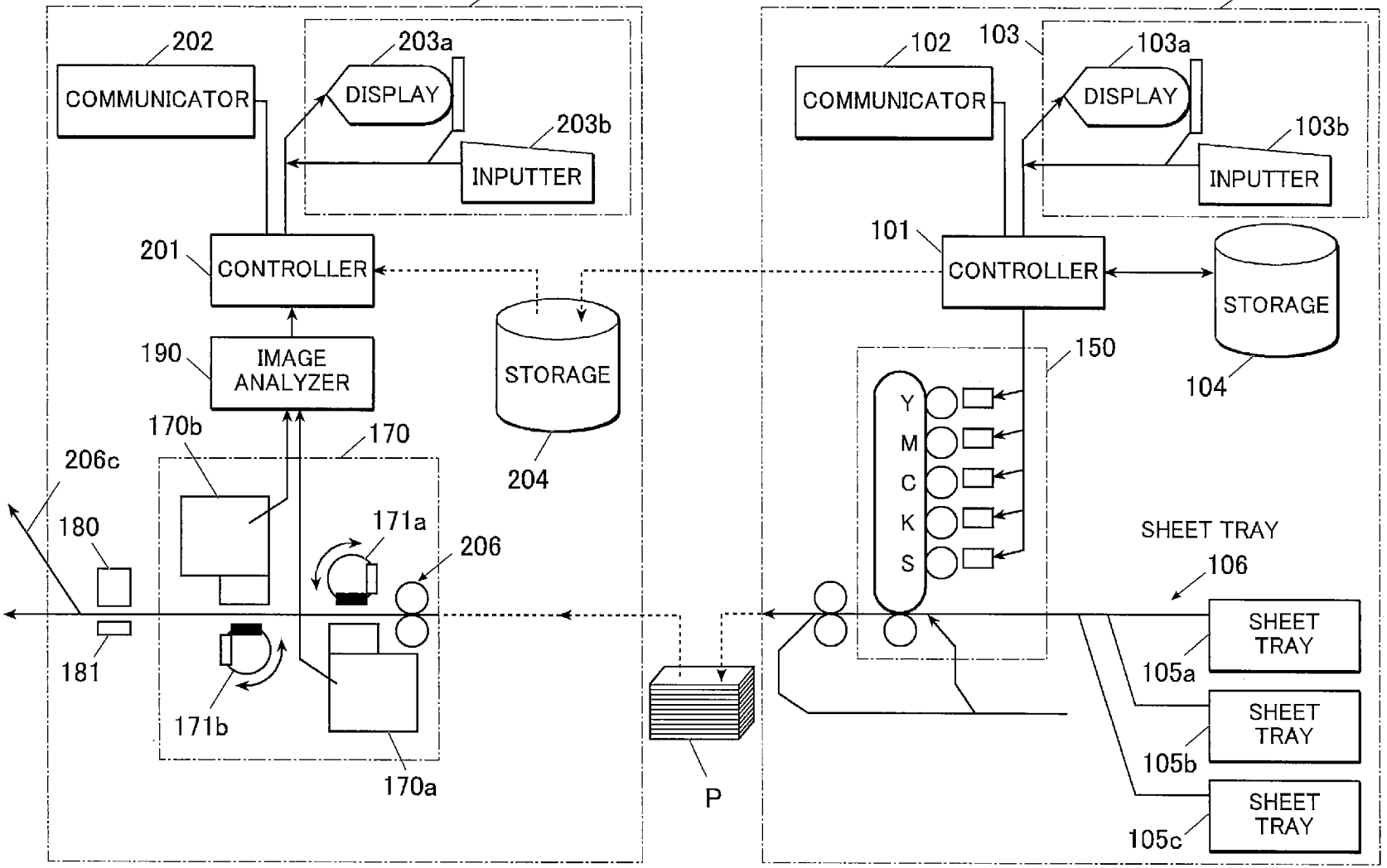
FIG. 10 is a diagram showing an example of a configuration when the image forming apparatus and the image inspection apparatus are configured to be separate apparatuses.

FIG. 10 is a diagram showing an example of a configuration in which the image forming apparatus (image forming apparatus 1) is a separate apparatus from the image inspection apparatus (image inspection apparatus 2). As shown in FIG. 10, the image inspection apparatus 2 includes a reader 170, a colorimeter 180, an image analyzer 190 as shown in FIG. 1, and also includes a controller (hardware processor) 201, a communicator 202, a display 203*a*, an inputter 203*b*, a storage 204, a conveyor 206 and the like.

The storage 204 stores parameters used in the control based on the measured result of the misalignment amount of the image position. Such control corresponds to when the density difference between the sheet and the background member is the predetermined value B0 or more, or when the above density difference is less than the predetermined value B0.

As shown in FIG. 10, the image inspection apparatus 2 conveys a sheet (printed material) in which an image is printed by the image forming apparatus 1 one by one from a sheet bundle P to the reader 170, and the sheet in which the image is printed is read. Here, the controller 201 receives the necessary information in the job information (job setting information) used when the image forming apparatus 1 performs printing before performing the measurement of the misalignment of the image position based on the read image or during the measuring of the misalignment of the image position so as to be in time for the analysis of the read image by the image analyzer 190. The controller 201 receives the information from the image forming apparatus 1 through the communicator 202 and stores the information in the storage 204. The controller 201 controls the image analyzer 190 to perform image analysis of the read image obtained by the reader 170 based on the received job information, measures the misalignment amount of the image position, and performs control based on the measured result of the misalignment amount of the image position. The job information includes a plurality of information necessary for measuring the misalignment of the position such as information of the sheet trays 105*a* to 105*c* used in the job of the image forming apparatus 1, the attribute such as the color, the size, and the sheet type of the sheet set in each sheet tray, total number of printed sheets, information of the adjustment function performed simultaneously or in coordination with the job, and the like. The control of the density of the background members 171*a* and 171*b* when the image is read (background surface set) and the control of the analysis is similar to the control performed in the image inspection apparatus incorporated in the image forming apparatus 100 as described in the above embodiment. Since the printing is already finished, as the control based on the measured result of the misalignment amount of the image position, the sheet is determined to be a defective product (waste paper) when the measured result of the misalignment amount of the image position is equal to or larger than the defective product determining threshold. Then, the control to eject the sheet from the sheet ejection path 206*c* is performed (inspection of product) Similar to the above-described embodiment, the defective product determining threshold is adjusted based on the density difference between the sheet and the background member. The printed result ejected as waste needs to be printed again. Therefore, reprint job information for reprinting is generated. The reprint job information may include the adjustment value to correct the misalignment of the image position based on the reason for the defective printing, for example.

FIG. 10 shows the image inspection apparatus 2 in which the sheet (printed material) with the image printed in the image forming apparatus 1 is conveyed one by one from the sheet bundle P to the reader 170, and the reading of the sheet with the image printed and the analysis of the read image is performed. Alternatively, the sheet with the image printed in the image forming apparatus 1 can be conveyed successively to the reader 170 as is, and the reading of the sheet with the image printed and the analysis of the read image can be performed.

Regarding the portion using the density in the above embodiment, the color can be used instead of the density.

According to the present embodiment, one predetermined value B0 is used, and an example in which the degree of control based on the measured result of the misalignment amount of the image position is divided into two stages. Alternatively, an N number of predetermined values can be used, and the control can be divided into N+1 stages (N is a positive integer).

According to the above-described embodiment, the background surface with the same density is set in both the background member 171*a* and the background member 171*b* but the background surface with a different density can be set.

According to the above description, a nonvolatile semiconductor memory or a hard disk is used as the computer-readable medium storing the program to execute the above processes, but the media is not limited to the above. As the computer-readable medium, a portable storage medium such as a CD-ROM, etc. can be applied. As the medium providing the data of the program through communication lines, a carrier wave can be applied.

The detailed configuration and the detailed operation of the units included in the image inspection apparatus and the image forming apparatus can be suitably changed without leaving the scope of the present invention.

Although embodiments of the present invention have been described and illustrated in detail, the disclosed embodiments are made for purposes of illustration and example only and not limitation. The scope of the present invention should be interpreted by terms of the appended claims

What is claimed is:

1. An image inspection apparatus comprising:

a reader which reads a sheet in which an image is printed, which reads the sheet together with a background, and which obtains a read image;

a background member which is provided in a position which is to be a background of the sheet when the sheet is read by the reader; and a hardware processor, wherein, the hardware processor extracts sheet outline information of the sheet from the read image and measures a misalignment of a position of the image with relation to the sheet based on the extracted sheet outline information, the hardware processor performs control based on a measured result of the misalignment of the position of the image, and the hardware processor adjusts a degree of control performed based on the measured result of the misalignment of the position of the image according to a density difference between the sheet and the background member.

2. The image inspection apparatus according to claim 1, wherein, the hardware processor eases a degree of the control performed based on the measured result of the misalignment of the position of the image when the density difference between the sheet and the background member is smaller than a predetermined value compared to when the density difference between the sheet and the background member is equal to or more than the predetermined value.

3. The image inspection apparatus according to claim 1, wherein, the control is image position adjustment which adjusts the misalignment of the position of the image based on the measured result of the misalignment of the position of the image.

4. The image inspection apparatus according to claim 3, wherein, the hardware processor performs the control also considering progress of the measured result of the misalignment of the position of the image.

5. The image inspection apparatus according to claim 1, wherein, the control is control in which the sheet is determined to be a defective product and is ejected when the measured result of the misalignment of the position of the image exceeds a predetermined threshold.

6. The image inspection apparatus according to claim 5, further comprising, a setter with which an operator sets a threshold to determine the defective product, and a notifier which notifies that a possibility that the sheet is discharged as the defective product increases when the threshold set on the setter is smaller than the predetermined threshold set in advance for the sheet in which the density difference between the sheet and the background member is smaller than a predetermined value.

7. The image inspection apparatus according to claim 1, wherein, the image inspection apparatus is configured to be capable of switching a density of the background member, and the hardware processor controls switching of the density of the background member.

8. The image inspection apparatus according to claim 7, wherein, the hardware processor measures the misalignment of the position of the image with relation to the sheet for each sheet in which an image is printed by an image forming apparatus performing a print job, and the hardware processor controls the density of the background member during the print job to be a density suitable for the sheet in which the number of sheets used is a largest number in the print job.

9. The image inspection apparatus according to claim 7, wherein, the hardware processor measures the misalignment of the position of the image with relation to the sheet for each sheet in which an image is printed by an image forming apparatus performing a print job, the image inspection apparatus further includes a selector with which an operator selects a sheet to be monitored for the misalignment of the position of the image while the print job is performed, and the hardware processor controls the density of the background member during the print job to be a density suitable for the sheet selected on the selector.

10. The image inspection apparatus according to claim 7, further comprising, an inputter with which an operator instructs the density of the background member, wherein, the hardware processor controls the density of the background member to be a density instructed on the inputter.

11. The image inspection apparatus according to claim 7, wherein, the hardware processor measures the misalignment of the position of the image with relation to the sheet for each sheet in which an image is printed by an image forming apparatus performing a print job, and the hardware processor controls the density of the background member during the print job according to an adjustment function performed simultaneously or in conjunction with the print job.

12. The image inspection apparatus according to claim 11, wherein, the hardware processor controls the background member to be black when adjustment of density of an output sheet is performed.

13. The image inspection apparatus according to claim 11, wherein, the hardware processor controls the background member to be white when calibration by a colorimeter is also performed.

14. The image inspection apparatus according to claim 7, wherein, the hardware processor measures a misalignment of the position of the image with relation to the sheet for each sheet in which an image is printed by an image forming apparatus performing a print job, and the hardware processor controls the density of the background member while the print job is performed based on a color of a sheet set in each sheet tray provided in the image forming apparatus or a color of a sheet set in a sheet tray used in the print job in which a density can be measured by a sensor or a measured result of the density.

15. An image forming apparatus which operates in coordination with the image inspection apparatus according to claim 1, the image forming apparatus comprising:

an image former which prints on a sheet an image including a position adjustment image used when the hardware processor performs the measurement, which selects a color material with a largest density difference from the sheet from among the color materials which can be used in the image forming apparatus when the position adjustment image is printed, and which prints the position adjustment image.

16. A control method used in an image inspection apparatus including a reader which reads a sheet in which an image is printed, which reads the sheet together with a background, and which obtains a read image; a background member which is provided in a position which is to be a background of the sheet when the sheet is read by the reader; and a hardware processor which extracts sheet outline information of the sheet from the read image, which measures a misalignment of a position of the image with relation to the sheet based on the extracted sheet outline information, and which performs control based on a measured result of the misalignment of the position of the image, the method comprising:

adjusting a degree of control performed based on the measured result of the misalignment of the position of the image according to a density difference between the sheet and the background member.

* * * * *